US009257107B1

(12) United States Patent
Belli et al.

(10) Patent No.: US 9,257,107 B1
(45) Date of Patent: Feb. 9, 2016

(54) MUSICAL DRUMHEAD WITH TONAL MODIFICATION

(71) Applicant: REMO, INC., Valencia, CA (US)

(72) Inventors: Remo D. Belli, Valencia, CA (US); Christopher J. Whitttington, Valencia, CA (US)

(73) Assignee: REMO, INC., Valencia, CA (US)

( * ) Notice: Subject to any disclaimer, the term of this patent is extended or adjusted under 35 U.S.C. 154(b) by 0 days.

(21) Appl. No.: 14/121,848

(22) Filed: Oct. 24, 2014

(51) Int. Cl.
*G10D 13/02* (2006.01)

(52) U.S. Cl.
CPC ..... *G10D 13/027* (2013.01)

(58) Field of Classification Search
CPC ... G10D 13/02; G10D 13/027; G10D 13/028; G10D 13/023; G10D 13/00; G10D 13/026; G10D 13/022; Y10T 156/10; Y10T 29/49; G10G 5/00
USPC ..... 84/414, 411 R
See application file for complete search history.

(56) References Cited

U.S. PATENT DOCUMENTS 5,293,000 A * 3/1994 Adinolfi ..... G10D 13/024 84/730

* cited by examiner

*Primary Examiner* — Kimberly Lockett
(74) *Attorney, Agent, or Firm* — Larry F. Gitlin; Beaumont Gotlin Tashjian

(57) ABSTRACT

A musical drum comprised of a drumshell and a drumhead, which includes a composite of tonal modifiers acting synergistically for dampening drum sounds by eliminating high frequencies and overtones. The tonal modifiers include a first tonal modifier comprised of synthetic material, a second tonal modifier bonded to the synthetic material in overlaying relation, a third tonal modifier positioned upon the second tonal modifier in overlaying relation, and a fourth tonal modifier bonded to the central portion of the third tonal modifier in overlaying relation, the combination of which cooperate to break down the various levels of harmonics to their purest form resulting in a unique sound and vibrational experience provided in a therapeutic context for the well-being of a person.

27 Claims, 9 Drawing Sheets

MUSICAL DRUMHEAD WITH TONAL MODIFICATION

BACKGROUND OF THE INVENTION

1. Field of the Invention

The present invention relates generally to a musical drum and, more particularly, to a musical drum incorporating a combination of cooperative tonal modifiers which produce levels of vibrations and resulting sounds that are uniquely therapeutic to the human body.

2. Description of the Prior Art

When a drumhead is struck with an object, it vibrates in modes, which enable the conjugation of certain frequencies. The lowest mode of vibration is its simplest form, as the film material used to fabricate the drumhead tends only to vacillate without any twisting or lateral motion. The only nodal point in this mode, which is the area with the least amount of vibration, is the outer perimeter of the drumhead.

The second mode tends to split the drumhead into halves, thereby creating higher partials or overtones.

The third mode of vibration divides the drumhead again into quarter-circle sections which, in turn, creates additional higher frequencies and overtones.

With only these three modes of vibrations in their most simple form (excluding, for example, the sound of a mallet striking the head, which will vary with the hardness and weight of the mallet on the head) a conventional drumhead can easily produce a complex series of harmonics. The principle objective of the present invention is to break down the various levels of harmonics and reduce other extemporaneous sounds to their purest form with the use of certain tonal modifiers, specifically the composite of tonal modifiers integral to the drumhead of the present invention, and to use the resulting unique sound in a therapeutic context for the well-being of a person.

A drum can be played by one person or many persons simultaneously. Ordinarily, the simultaneous playing of a single drum by a group of players is impractical, particularly in an indoor setting, given that the sounds that are generally produced would be excessively loud and complex and rhythmically and musically antithetical to a pleasing experience. Certain drums, such as, for example, the so-called Pow Wow drum with its deep sidewalls, do not permit the players to sit sufficiently close enough to a drum positioned horizontally.

The group playing of a single drum was common among Native American tribes. But since the majority of the drums then were relatively small, it was necessary for the players to sit at a distance from the drum and to use a single mallet or stick to strike the drumhead. Since the drums were played outdoors, there was no need to be concerned about the loudness of the sound volume, as quietness was not a requisite.

In the modern world, music therapists use percussion instruments, including various versions of the musical drum, in group settings and often in quiet institutions, such as hospitals and nursing homes. Within this context, there is a need for a single drum that many may comfortably share, whether, for example, while sitting in a conventional chair or wheelchair, or standing, to ensure the experience of the healing benefits of the therapeutic sounds and vibrations produced. Accordingly, the present invention fulfills a long felt need by providing a drum with a vibratory membrane (i.e. the drumhead), which incorporates a rare combination of tonal modifiers that act synergistically to break down the various levels of harmonics, as described, to suppress overtones and produce a unique therapeutic sound. This therapeutic sound comprises a single dominant low frequency sonic wave experienced throughout the human body when a person is sitting or standing in close proximity to the drum.

SUMMARY OF THE INVENTION

The present invention provides a musical drum comprised of a drumshell and a drumhead, which includes a composite of tonal modifiers acting synergistically for dampening drum sounds by eliminating high frequencies and overtones. The tonal modifiers include a first tonal modifier comprised of a two-ply synthetic material, a second tonal modifier bonded to the two-ply synthetic material in overlaying relation, a third tonal modifier positioned upon the second tonal modifier in overlaying relation, and a fourth tonal modifier bonded to the central portion of the third tonal modifier.

In the preferred embodiment of the present invention, the first tonal modifier is comprised of polyester, typically a two-ply polyester, such as Mylar®, the second tonal modifier is comprised of a semi-rigid polyvinyl chloride sheet material, the third tonal modifier is comprised of a woven cotton fabric material and the fourth tonal modifier is comprised of a semi-rigid polyvinyl chloride sheet material, though smaller in diameter than the diameter of the sheet material comprising the second tonal modifier.

Accordingly, it is an object of the present invention to provide a musical drum with an improved drumhead comprised of a composite of tonal modifiers for dampening drum sounds.

It is another object of the present invention to provide a musical drum with an improved drumhead comprised of a composite of cooperating tonal modifiers for dampening drum sounds by eliminating high frequencies and overtones.

Another object of the present invention is to provide a musical drum with an improved drumhead that, in the process of suppressing overtones, produces a therapeutic sound.

Another object of the present invention is to provide a musical drum with an improved drumhead that produces a therapeutic sound experienced throughout the human body for providing a feeling of wellness.

Another object of the present invention is to provide a musical drum with an improved drumhead that produces a single dominant low frequency sonic wave that can be felt by a person standing or sitting nearby the drum.

Another object of the present invention is to provide a musical drum with an improved drumhead that can be played and enjoyed by one person alone, or by many persons simultaneously.

Another object of the present invention is to provide a musical drum with an improved drumhead that provides a continuous pulsating massage-like experience to persons sitting or standing adjacent the drum or sitting or lying beneath the drumhead.

Another object of the present invention is to provide a musical drum with an improved drumhead that easily enables a person sitting up close to the drumhead the freedom to position the legs beneath the drumhead and comfortably play the drum.

Another object of the present invention is to provide a musical drum with an improved drumhead that is easy and cost effective to manufacture.

Other objects and advantages of the present invention will become apparent in the following specifications when considered in light of the attached drawings wherein the preferred embodiment of the invention is illustrated.

DETAILED DESCRIPTION OF THE PREFERRED EMBODIMENT

Figure 1:
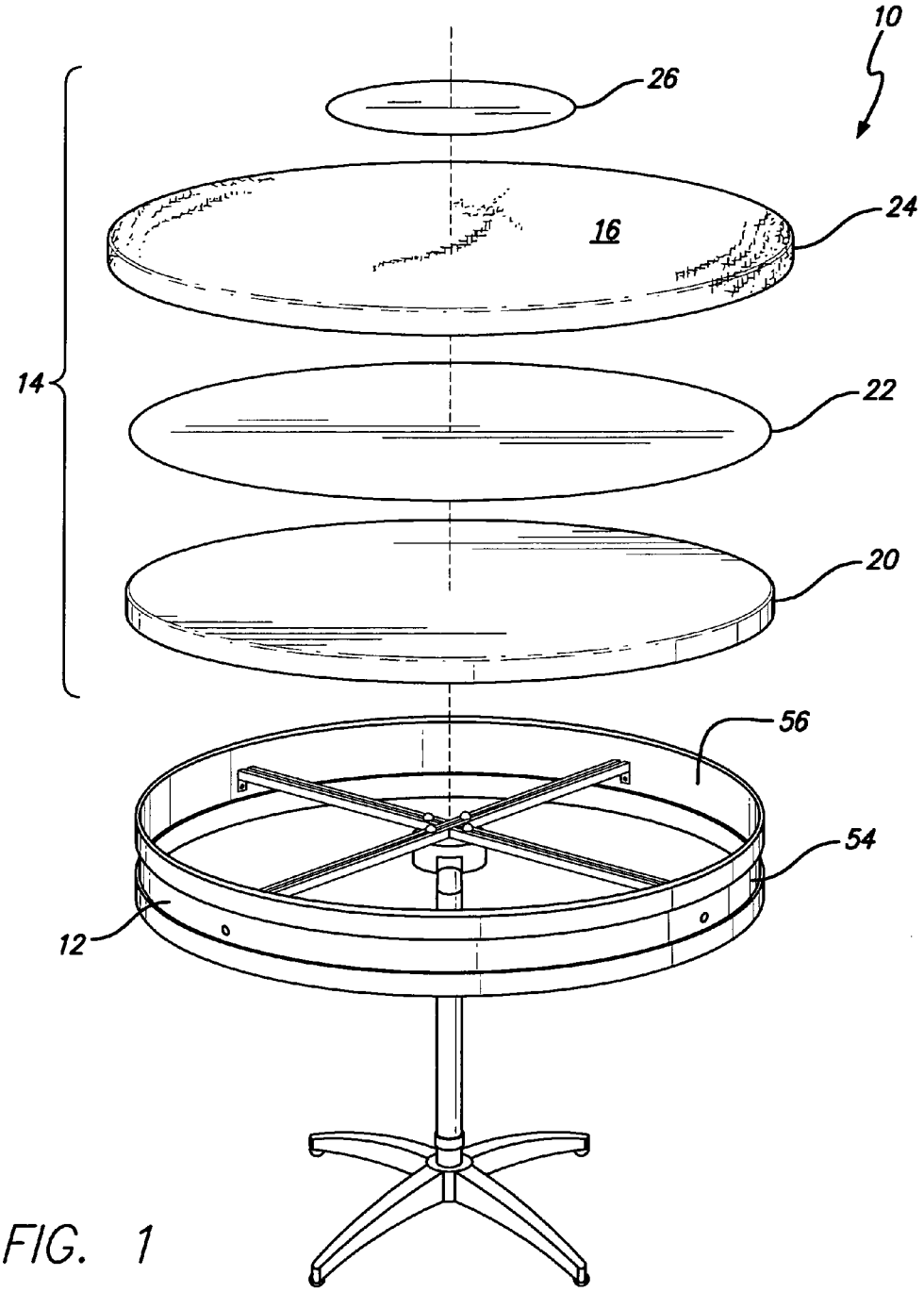
FIG. 1 is an exploded perspective view of the musical drum in accordance with the present invention.
Figure 2:
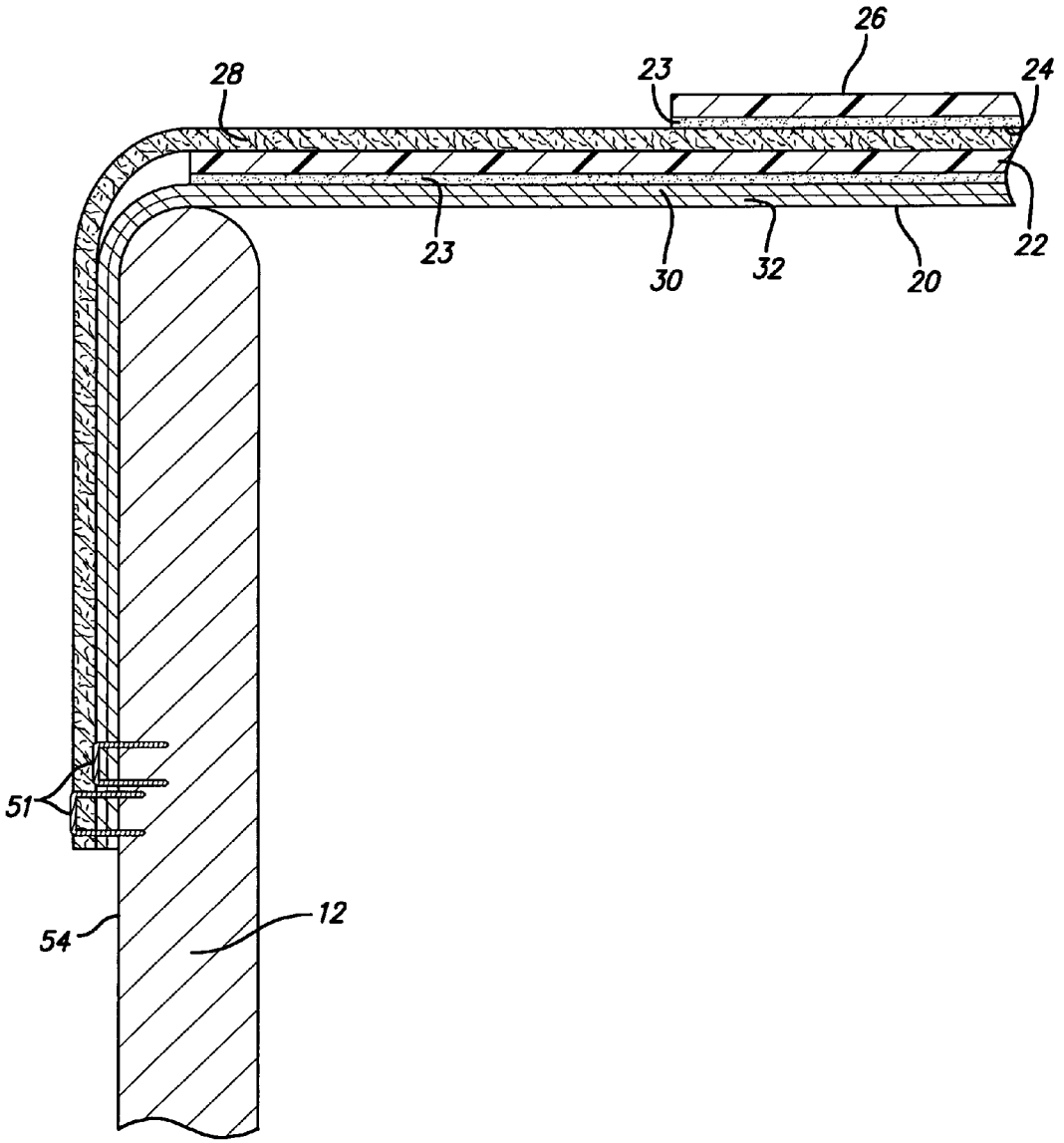
FIG. 2 is a cross-sectional view of the drumhead portion of the musical drum in accordance with the present invention.

The present invention will be described in more detail with reference to the preferred embodiment shown in FIGS. 1 through 10.

Musical drum 10 is comprised of drumshell 12, including exterior sidewall 54 and interior sidewall 56, and drumhead 14, which consists of first tonal modifier 20, second tonal modifier 22, third tonal modifier 24, and fourth tonal modifier 26. The composite of uniquely cooperative tonal modifiers 20, 22, 24, and 26 are provided for dampening sounds produced by musical drum 10, particularly drumhead 14, by eliminating high frequencies and overtones in accordance with the present invention.

The preferred embodiment of the present invention consists of a composite of the following: tonal modifier 20 is comprised of a polyester material, typically two-ply, such as Mylar®, which includes first ply 30 and second ply 32, which float, and thus, dampen, reciprocally. The durability of tonal modifier 20 is enhanced due to the thickness of overlapping plies 30 and 32. The preferred thickness of the polyester film is 0.0075". Tonal modifier 20 achieves the initial dampening of the higher partials or overtones.

Second tonal modifier 22 is comprised of a semi-rigid polyvinyl chloride sheet material, the preferred material with a thickness of 0.010". Tonal modifier 22, which is attached to tonal modifier 20 by adhesive 23 or some other suitable bonding agent is usually about 0.007" thick. The bonding of tonal modifier 22 to tonal modifier 20 greatly enhances the rigidity of drumhead 14 and, thus, removes the twisting motion, which prevents drumhead 14 from dividing into half or quarter sections. The added weight of tonal modifier 22, or "mass loading" as it is sometimes called, also slows the vibrations and lowers the pitch of drumhead 14.

Third tonal modifier 24 is comprised of a woven cotton fabric material, such as the material commonly known as duck cloth, the preferred material for this tonal modifier component. Woven duck cloth is extremely supple and, depending on the actual thread count, denier, and weave pattern will easily drape (float, not bonded) over attached tonal modifier 20 and 22, causing it to further suppress sound. Tonal modifier 24 is generally a high tenacity heavy plain woven fabric that is strong and long lasting and very appropriate for use with drumhead 14, which is being struck repeatedly with the hands or a hard object, such as a drumstick (not shown) or mallet 58. Tonal modifier 24, in combination with attached tonal modifiers 20 and 24, builds on the initial two-ply polyester concept whereby the combination of attached tonal modifiers 20 and 22, and tonal modifier 20 are not bonded, thereby creating phase interference between the two vibrating members. This creates mass loading and consequently contributes to the lowering of the pitch of drumhead 14. Additionally, tonal modifier 24 is saturated with water-based sealer 28, which is known by the trademark Haloflex™, the preferred sealer for this purpose, so that the fabric surface can be sealed and easily cleaned. Typically, the material comprising tonal modifier 24 is 0.024" thick. Applied sealer 28 soaks into the cotton weave of the material comprising tonal modifier 24 and also forms a thin film on the top and bottom surfaces, respectively. The combined thickness of the two, i.e. the cotton fabric and sealer, is 0.034".

Fourth tonal modifier 26, in its preferred form, is comprised of a semi-rigid polyvinyl chloride sheet material, though smaller in diameter than the sheet material used to fabricate second tonal modifier 22. Tonal modifier 26, which is bonded to tonal modifier 24 by adhesive 23, covers approximately 40% of the overall diameter of drum 10, and offers additional mass loading of drumhead 14, but mostly only in its center portion 16. The weight of the material comprising tonal modifier 26 enhances the vacillating motion of the vibrating member over a greater period of time. The material comprising tonal modifier 26 has a thickness of 0.010". Adhesive 23, after the application to tonal modifier 26, is approximately 0.007" thick.

Figure 5:
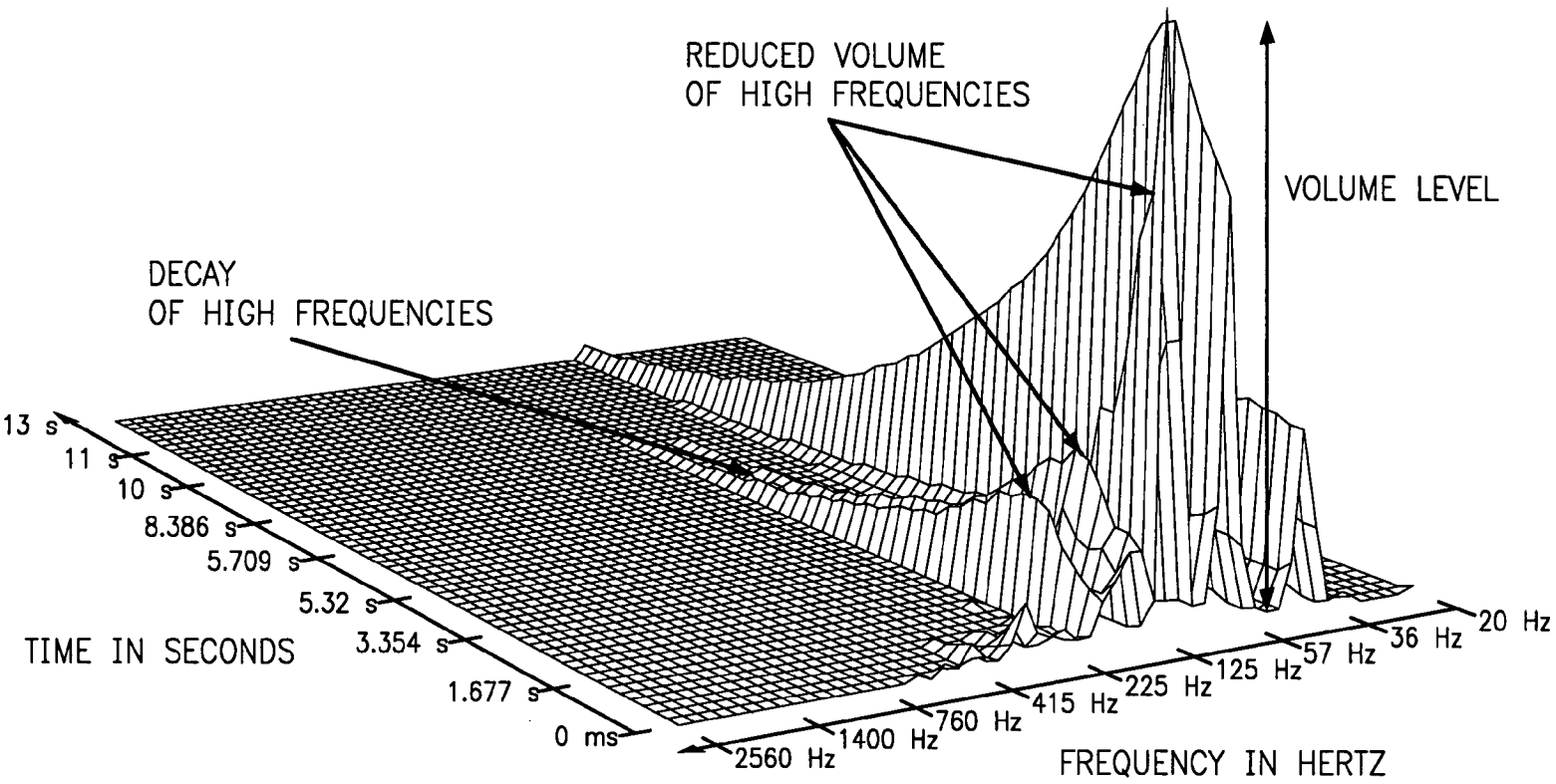
FIG. 5 is a spectrum analysis of the sound frequencies (in hertz) produced by striking a drumhead having only a conventional single tonal modifier.
Figure 6:
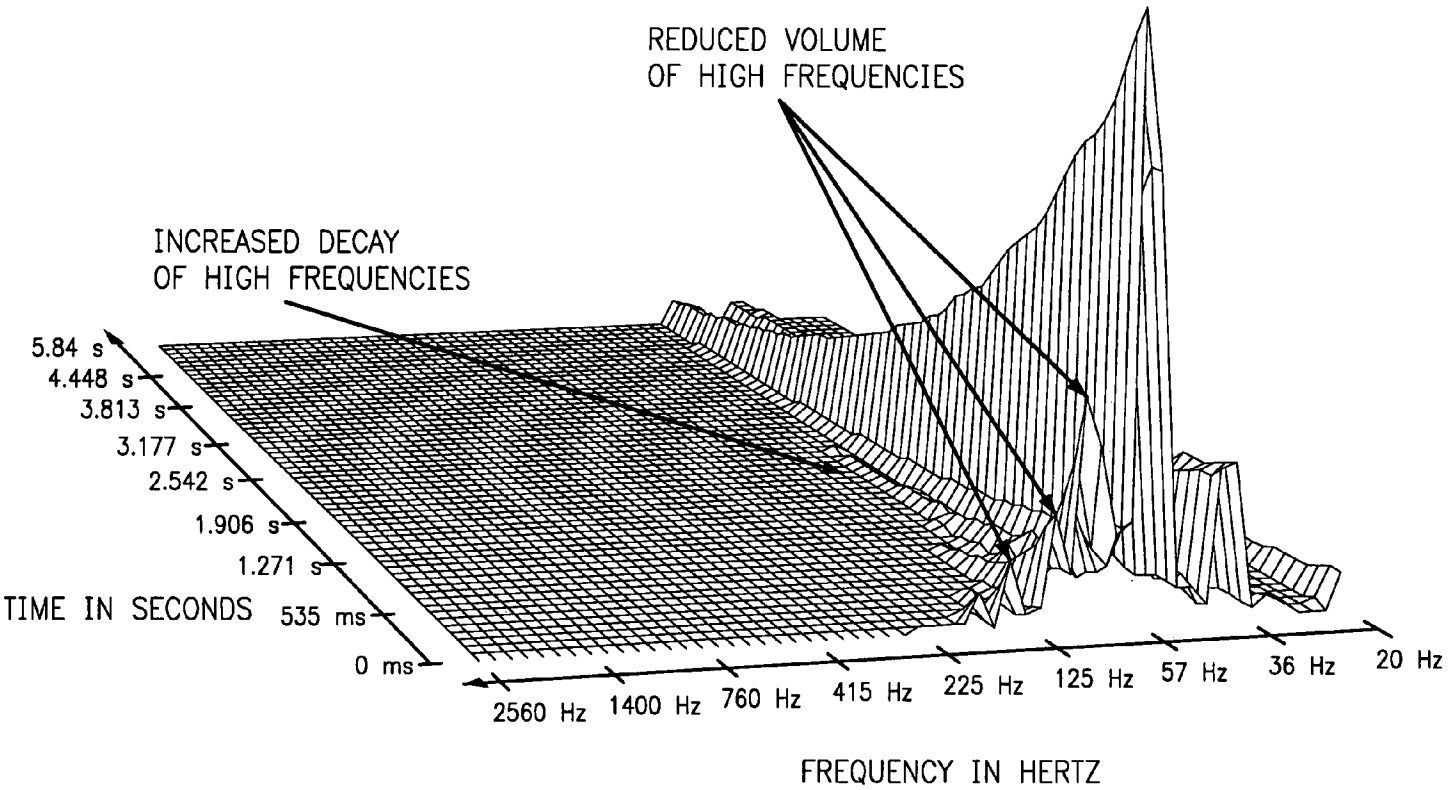
FIG. 6 is a spectrum analysis of the sound frequencies (in hertz) produced by striking a drumhead having a composite of cooperative tonal modifiers in accordance with the present invention.
Figure 7:
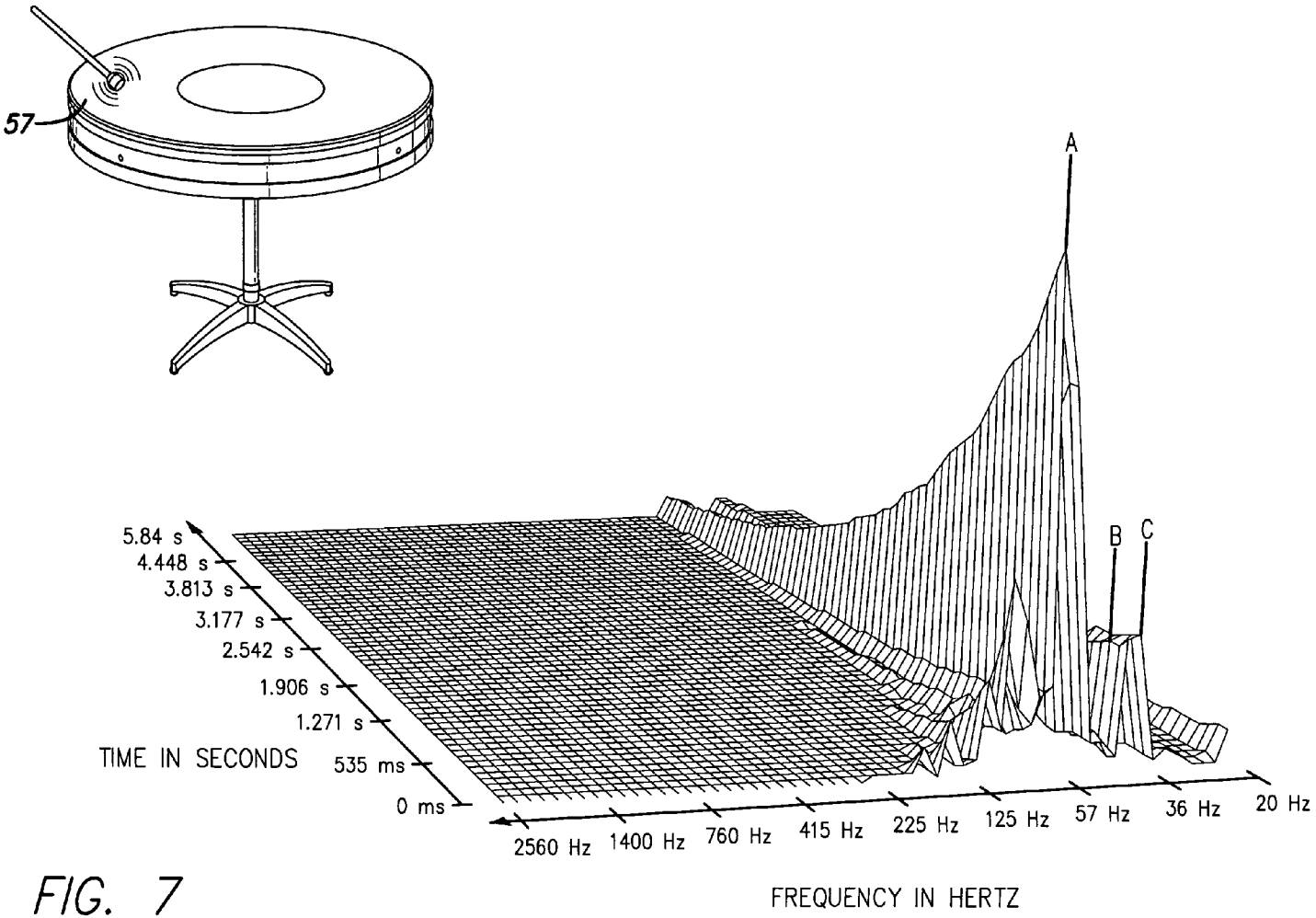
FIG. 7 depicts a mallet striking a drumhead near its edge and a spectrum analysis of the sound frequency attenuation when a drumhead is so struck in accordance with the present invention.

A tonal modifier incorporated into a musical drumhead normally affects the sound volume at the highest frequencies, as shown in FIG. 5 and in FIG. 6 in accordance with the present invention. FIG. 5 shows a spectrum analysis of musical drum 10 (40" in diameter) with drumhead 14 having only a conventional single tonal modifier comprised of two plies (30, 32) of a suitable synthetic material, such as polyester. With time shown in seconds and frequency in hertz, the volume level of sound produced when drumhead 14 is struck reaches its highest level.

FIG. 6 shows a spectrum analysis of musical drum 10 (40" in diameter), such as, for example, drumhead 14 with a composite of synergistically acting tonal modifiers 20, 22, 24 and 26 in accordance with the present invention. Shown with time in seconds and frequency in hertz, the volume level of the unique sound produced when drumhead 14 is struck decays at a much greater rate than the previous example shown in FIG. 5, which produced merely a single dominant low frequency of sound.

Figure 8:
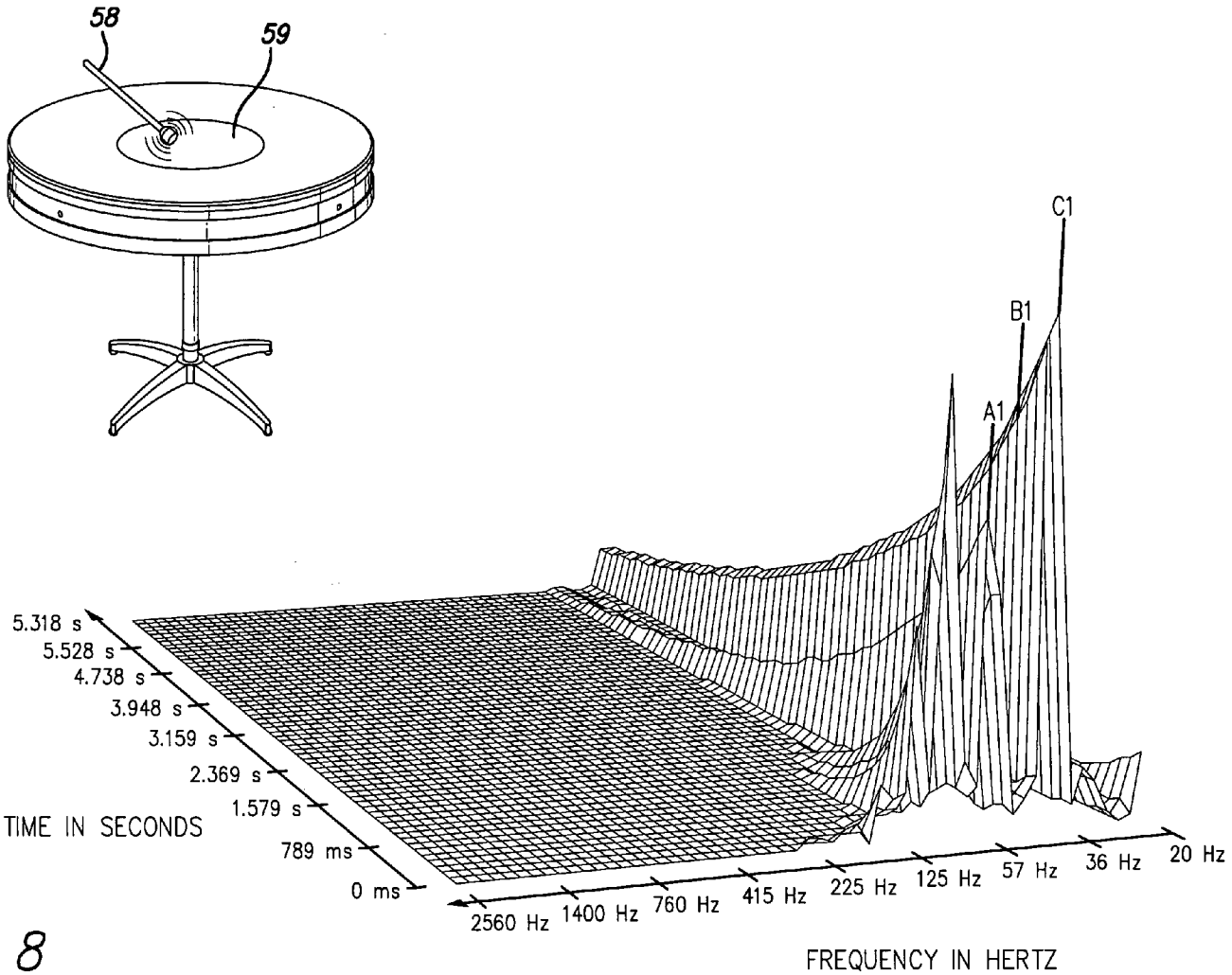
FIG. 8 depicts a mallet striking a drumhead near or at its center and a spectrum analysis of the sound frequency attenuation when a drumhead is so struck in accordance with the present invention.
Figure 9:
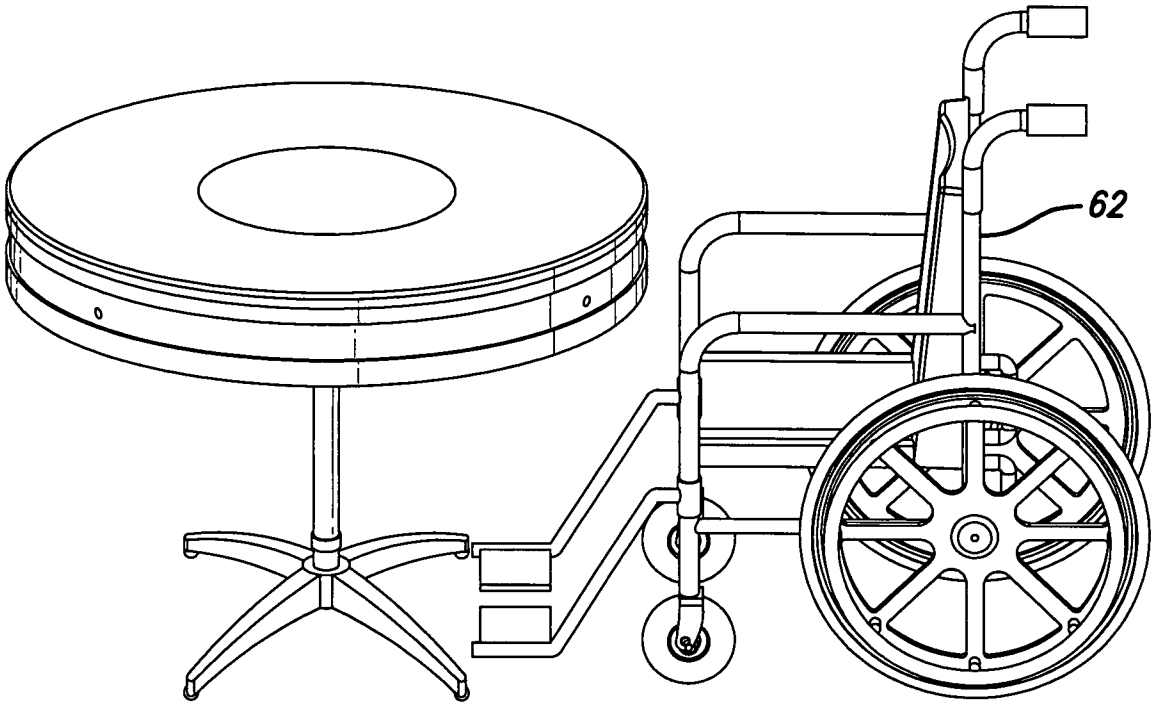
FIG. 9 is a perspective view of a musical drum in accordance with the present invention shown with a wheelchair positioned in close proximity.
Figure 10:
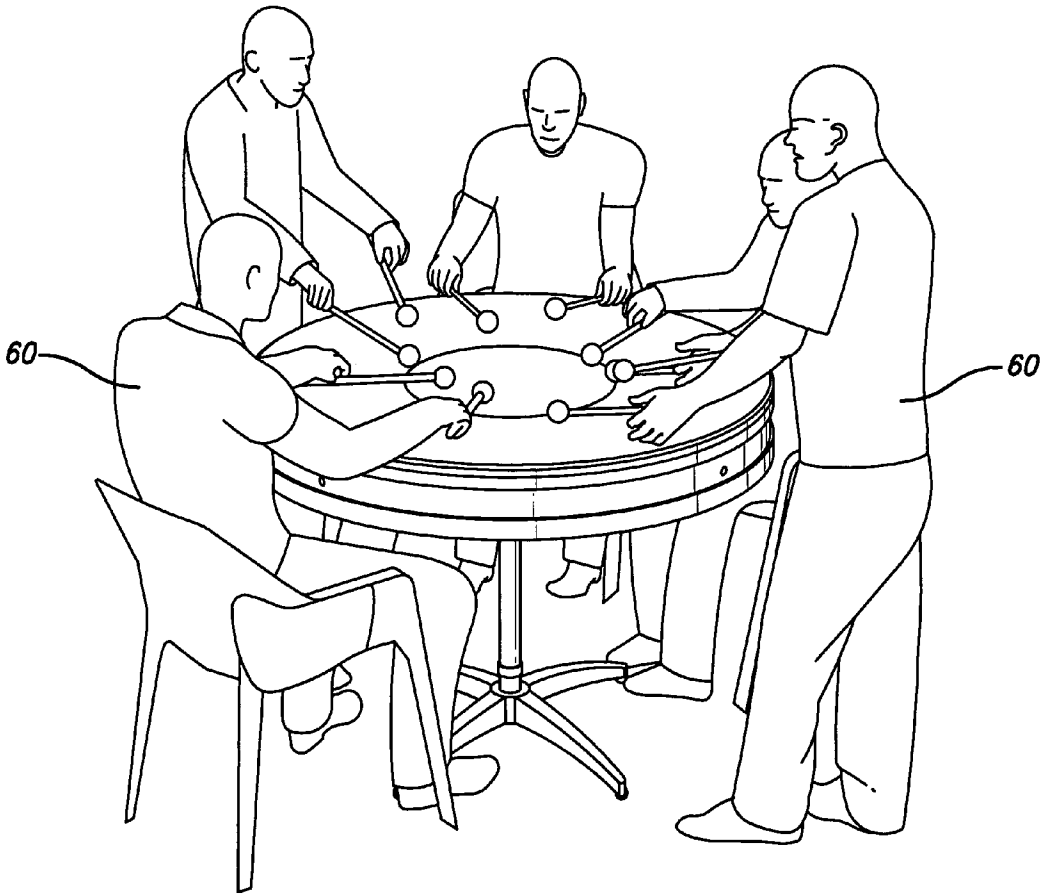
FIG. 10 is a perspective view of a musical drum in accordance with the present invention shown with several persons sitting and standing in close proximity playing the drumhead with a hard object by striking at or near its center.

With all four tonal modifiers 20, 22, 24 and 26 combined and cooperating, as above described, the frequency attenuation is at its highest when drumhead 14 is struck near its outermost edge 57 (see FIG. 7 and designations A, B and C) and at its lowest (i.e. the lowest notes are loudest and more apparent) when drumhead 14 is struck nearest or slightly off its center 59 (see FIG. 8 and corresponding designations A1, B1 and C1).

Figure 3:
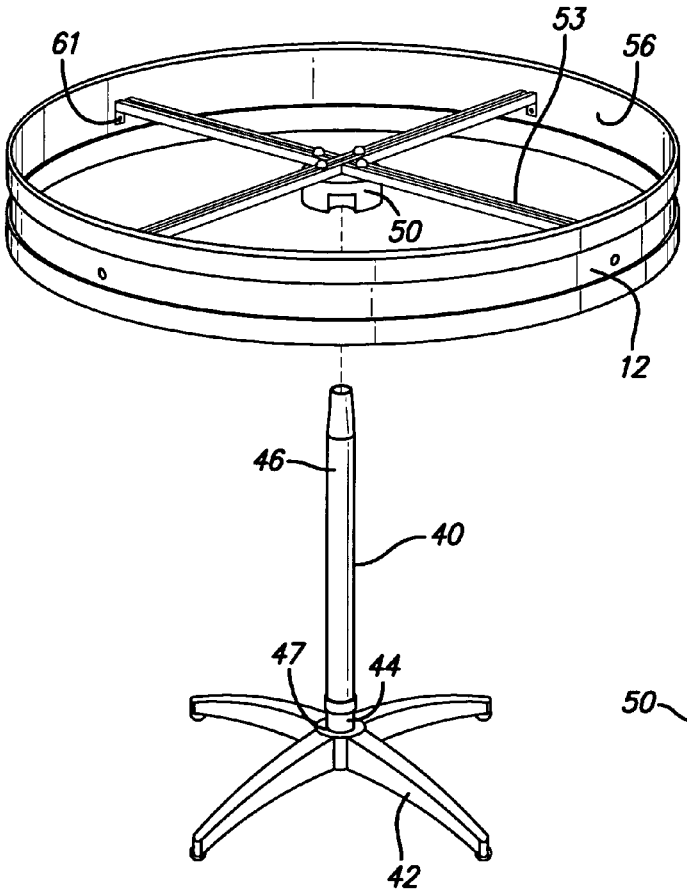
FIG. 3 is a perspective view of a musical drum with a center pedestal stand in accordance with the present invention.
Figure 4:
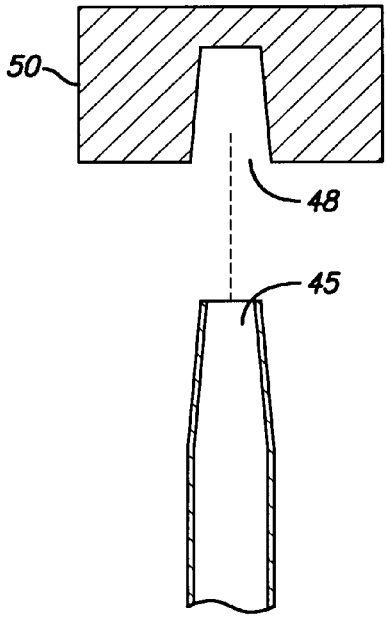
FIG. 4 is a cross-sectional view of the hub and post components used in conjunction with the pedestal stand to support the musical drum in accordance with the present invention.

Stand 40 used to support drum 10 of the preferred embodiment of the present invention is the pedestal type, as shown in FIGS. 1 and 4. Stand 40 is attached to drumshell 12 utilizing hub 50, as shown in FIG. 3 and in cross-section in FIG. 4. Hub 50 around its periphery is connected to a plurality of support spokes 53 that radiate to engage interior sidewall 56 of drumshell 12 where each is attached equidistantly using any suitable attachment means, including, without limitation, rivets 61, or screws, bolts, fasteners and heavy staples (not shown), which may also be utilized for attaching spokes 53 to hub 50. Pedestal base 42 and vertical post 46 are connected by inserting tapered bottom end 44 of vertical post 46 into tapered conforming opening 48 and tapered top end 45 into conforming tapered opening 47. Both bottom ends 44 and 45, and respective conforming openings 47 and 48 are tapered to establish a tight, stable connection making it normally unnecessary to use tools to attached drum 10 to pedestal stand 40.

The drum shown in FIGS. 1, 3, 9 and 10 can be arranged so that four or more players 60 can sit or stand around the drum comfortably and play it with their hands or with the use of mallets or the like. The pedestal stand, the short depth of the drumshell and the absence of any outer drum support stands or hardware that would hinder their playing allows for a player in a wheelchair 62 to be a part of the group drumming experience as well. Additionally, with the drum in a horizontal and relatively high position, children and smaller adults (not shown) can literally sit or lie down under drum 10 and feel the sound waves as drum 10 is being played. Since sound waves move in a simple vacillating motion similar to a loudspeaker, most, if not all, of the waves will strike the person directly, resulting in a continuous pulsating massage-like experience.

The body shape of the drum will also determine which frequencies are enhanced, dampened or in some cases completely eliminated. For instance, a bowl-shaped drum, such as an African djembe, will accent certain bass frequencies because it acts as a tuned resonator. Other straight-sided drums will do the same if the length of the drumshell is extended sufficiently so that the air inside can be contained enough to vibrate. Short depth drums, on the other hand, do little to create additional tonal properties. The short shell is used more for its framework to house and support the drumhead and increase the sustain of the drumhead if the drumshell frame is suspended and free to vibrate. Preferred drum diameters for drum table 10, the example shown in the drawings, are 22", 30", and 40" with the thickness of drumshell 12 of ½" to ¾". Drumhead 14, more particularly the polyester film of tonal modifier 20 and the woven duck cloth of tonal modifier 24, is tensioned over drumshell 12 and held in place against exterior sidewall 54 with staples 51, rivets or any other suitable attachment means (not shown).

While the invention is described in connection with a certain preferred embodiment, it is understood that it is not intended to limit the invention to that particular embodiment. Rather, it is intended to cover all alternatives, modifications and equivalents as may be included within the spirit and scope of the invention as defined by the appended claims.

The invention claimed is:

1. A musical drum comprising:

a drumshell, said drumshell having a continuous sidewall; and, a drumhead, said drumhead comprised of a composite of tonal modifiers for dampening drum sounds by eliminating high frequencies and overtones, said tonal modifiers include a first tonal modifier means comprising a sheet of synthetic material, a second tonal modifier means attached to said synthetic material in overlying relation, a third tonal modifier means engaging said second tonal modifier means in overlying relation, and a fourth tonal modifier means attached to a generally centralized section of said third tonal modifier means in overlying relation.

2. The musical drum of claim 1 wherein said synthetic film is comprised of a two-ply polyester material.

3. The musical drum of claim 2 wherein said two-ply polyester film is 0.0075" in thickness.

4. The musical drum of claim 1 wherein said second tonal modifier means comprises a semi-rigid polyvinyl chloride sheet material.

5. The musical drum of claim 4 wherein said polyvinyl chloride sheet material is 0.010" in thickness.

6. The musical drum of claim 1 wherein said synthetic material and said second tonal modifier means are adhesively attached.

7. The musical drum of claim 6 wherein said adhesive material is 0.007" in thickness.

8. The musical drum of claim 1 wherein said third tonal modifier means is comprised of a woven cotton fabric material.

9. The musical drum of claim 8 wherein said woven cotton fabric material is 0.024" in thickness.

10. The musical drum of claim 9 wherein said woven cotton fabric material is saturated with a water-based sealer.

11. The musical drum of claim 10 wherein said water-based sealer forms a film on the top surface and the bottom surface of said cotton fabric.

12. The musical drum of claim 11 wherein the combination of said woven cotton and said applied water-based sealer film are 0.034" in thickness.

13. The musical drum of claim 1 wherein said fourth tonal modifier means comprises a semi-rigid polyvinyl chloride sheet material.

14. The musical drum of claim 13 wherein said semi-rigid polyvinyl chloride sheet material is 0.010" in thickness.

15. The musical drum of claim 14 wherein said semi-rigid polyvinyl chloride sheet material and said third tonal modifier means are adhesively attached.

16. The musical drum of claim 15 wherein said adhesive material is 0.007" in thickness.

17. The musical drum of claim 13 wherein said semi-rigid polyvinyl chloride sheet material is attached generally to the central portion of said third tonal modifier means.

18. The musical drum of claim 1 wherein said sidewall of said drumshell has a height in the range of 2.5" to 5".

19. The musical drum of claim 1 wherein said drumshell has a diameter ranging from 22" to 40".

20. The musical drum of claim 1 wherein the thickness of said sidewall of said drumshell is within the range of ½" to ¾".

21. The musical drum of claim 1 wherein said drumshell is supported by a pedestal base.

22. The musical drum of claim 21 wherein said pedestal base supports said musical drum in a horizontal position.

23. The musical drum of claim 1 in combination with one or more sitting or standing persons positioned in close proximity to said drum wherein said composite of tonal modifiers cooperate synergistically upon being struck by an object to impart therapeutic vibrations throughout the body of one or more said persons.

24. The musical drum of claim 1 wherein the lower portion of said body of one or more of said persons is positioned below said drumhead.

25. The musical drum of claim 1 wherein one or more of said persons is standing adjacent said drumhead.

26. The musical drum of claim 1 wherein said first tonal modifier is tensioned and attached to said sidewall with means from the group comprising staples, rivets, screws and nails.

27. The musical drum of claim 1 wherein said third tonal modifier is tensioned and attached to said sidewall with means from the group comprising staples, rivets, screws and nails.

* * * * *